US006634101B2

(12) United States Patent
Sato

(10) Patent No.: US 6,634,101 B2
(45) Date of Patent: Oct. 21, 2003

(54) METHOD OF MANUFACTURING METAL FITTINGS FOR CONNECTION WITH A JOINT CONNECTOR

(75) Inventor: Kei Sato, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 12 days.

(21) Appl. No.: 09/987,559

(22) Filed: Nov. 15, 2001

(65) Prior Publication Data

US 2002/0028608 A1 Mar. 7, 2002

Related U.S. Application Data

(62) Division of application No. 09/456,068, filed on Dec. 6, 1999, now Pat. No. 6,332,811.

(30) Foreign Application Priority Data

Dec. 7, 1998 (JP) ..... P 10-347061

(51) Int. Cl.[7] ..... H01R 43/20

(52) U.S. Cl. ..... 29/876; 29/827; 29/861; 29/884; 439/399; 439/885

(58) Field of Search ..... 29/827, 861, 871, 29/872, 874, 876, 878, 882, 884; 439/397, 399, 497, 701, 717, 718, 885

(56) References Cited

U.S. PATENT DOCUMENTS 4,807,358 A * 2/1989 Dechelette et al. ..... 29/857
5,030,138 A 7/1991 Capp et al. ..... 439/497
5,286,225 A 2/1994 Tsuji ..... 439/752
5,660,563 A 8/1997 Chevarie et al. ..... 439/512
5,662,487 A * 9/1997 Okamura et al. ..... 439/189
5,749,752 A 5/1998 Kashiyama ..... 439/753.1
6,059,612 A 5/2000 Aoyama et al. ..... 439/701

FOREIGN PATENT DOCUMENTS

JP 8-64314 3/1996

* cited by examiner

*Primary Examiner*—Carl J. Arbes
*Assistant Examiner*—Donghai Nguyen
(74) *Attorney, Agent, or Firm*—Finnegan, Henderson, Farabow, Garrett & Dunner, L.L.P.

(57) ABSTRACT

A joint connector includes a metal fittings assembly 110 and a housing 120 for fitting the assembly 110. The assembly 110 consists of two terminals 110A, 110B each having a band-shaped carrier 140 and a plurality of terminal units 130 connected to the carrier 140 through a joint portion 137. In the assembly 110, the terminals 110A, 110B are laid to overlap each other while the terminals 110A, 110B are shifted from each other in a predetermined length in the longitudinal direction of the carriers 140 and the carriers 140 are welded to each other. By bending the joint portions 137 of the upper terminal 110A by a plate thickness of the carrier 140 of the terminal 110B, it is possible to position the adjoining terminal units 130 of the terminals 110A, 110B in an identical plane.

1 Claim, 10 Drawing Sheets

METHOD OF MANUFACTURING METAL FITTINGS FOR CONNECTION WITH A JOINT CONNECTOR

This is a division of application Ser. No. 09/456,068, filed Dec. 6, 1999 now U.S. Pat. No. 6,332,811, incorporated by reference.

BACKGROUND OF THE INVENTION

1. Field of the Invention

The present invention relates to a joint connector and a method of manufacturing metal fittings for connection with the joint connector.

2. Description of the Related Art

A connector assembly is disclosed in Japanese Unexamined Patent Publication (kokai) No. 8-64314. In this publication, as shown in FIG. 1, a connector element is provided by firstly stacking two lead frames 2, 3 each having a plurality of contacts 1 on each other, welding the lead frames 2, 3 together, subsequently fixing them with an insulating housing block 4, and finally eliminating all of band-shaped carriers of the lead frames 2, 3. Next, as shown in FIG. 2, the contacts 1 of the completing connector element are inserted into contact-accommodating spaces formed in another insulating housing block 5.

In the above-mentioned conventional connector assembly, however, it has been necessary to prepare the insulating housing blocks 4 of various kinds corresponding to the number of layers defined in the insulating housing block 5 because the blocks 4, 5 are different from each other in structure, thereby causing the number of components to be increased. Therefore, the production/management of the components and the assembling work become troublesome to make it difficult to reduce the manufacturing cost.

Further, since the contacts 1 of each connector element are to be bent after the lead frames 2 3 have been stacked on each other, there is a problem and the welding part may be subjected to stress.

Additionally, in the conventional connector assembly, it has been impossible to perform the connection between the connector elements in the vertical direction, thereby requiring connection wires.

SUMMARY OF THE INVENTION

Under such a circumstance, it is therefore an object of the present invention to provide a joint connector of low cost, which is capable of facilitated assembling work and various circuit arrangements and which also allows a reliable connection to be effected with ease.

The object of the present invention described above can be accomplished by a joint connector comprising:

a metal fittings assembly including two terminals in stack, each terminal having a band-shaped carrier and a plurality of terminal units connected to the carrier at substantial right angles and arranged in parallel with each other in the longitudinal direction of the carrier; and a housing having a plurality of unit accommodating parts formed for accommodating the terminal units of the terminals therein;

wherein the two terminals are laid to overlap each other while the terminals are shifted from each other in a predetermined length in the longitudinal direction of the carriers, and the so-overlapped carriers are welded to each other; and wherein either one of the upper and lower terminals in stack is provided, at respective joint portions between the carrier and the terminal units, with bending parts which result by bending the joint portions by a plate thickness of the carrier of the other terminal, thereby positioning the adjoining terminal units of the terminals in an identical plane.

In the present invention, since two terminals are overlapped on each other while one of the terminals is shifted from the other terminal in the predetermined length in the longitudinal direction of the carriers, it is possible to reduce a space between the adjoining terminal units. Thus, the metal fittings assembly can be small-sized thereby to also miniaturize the housing for accommodating the metal fittings assembly. Additionally, owing to the provision of the bending parts, the terminal units of the metal fittings assembly are positioned in the identical plane. Consequently, it is possible to provide the housing with the unit accommodating parts (e.g. grooves) in the same level, thereby simplifying the structure of a mold for the housing.

According to the second aspect of the invention, in the above-mentioned invention, the terminals are laid to overlap each other while the terminals are also shifted from each other in a direction perpendicular to the longitudinal direction of the carriers.

In this case, with the above arrangement, it is possible to dispose the terminal units in the identical plane by bending the terminal being shifted forward.

According to the third aspect of the invention, in the above-mentioned invention, the two terminals constituting the metal fittings assembly are both identical in configuration, while each of the band-shaped carriers of the terminals is obtained by cutting a continuous long carrier piece by a predetermined length.

In this case, since the terminals are both identical in configuration, there is no need to increase the sorts of components. Further, even when the terminals are overlapped while being shifted from each other back and forth, the simple bending of the terminal allows respective front ends of the terminal units to be positioned uniformly.

According to the fourth aspect of the invention, in the above-mentioned invention, each of the terminals has a plurality of positioning holes formed in the carrier at predetermined intervals in the longitudinal direction of the carrier, the positioning holes formed in one of the terminals being profiled so as to agree with the positioning holes formed in the other terminal when the terminals are laid to overlap each other.

In this case, if only according the positioning holes of the terminal with those of the other terminal, then the mutual positioning of the terminals can be accomplished with ease.

According to the fifth aspect of the invention, in the above-mentioned invention, each of the terminal units has a connecting piece formed on a leading end portion of the terminal unit so as to project upward and an inserting piece formed on the leading end portion so as to extend downward, the connecting piece being engageable with the inserting piece of the other terminal unit.

According to the sixth aspect of the invention, in the above-mentioned invention, the housing is provided, in each of the unit accommodating parts, with a slit into which the inserting piece of the terminal unit is to be inserted.

Owing to the provision of the connecting piece, the inserting piece and the slit, under condition that a plurality of housings are stacked vertically, it is possible to electrically connect the upper and lower terminal units with each other through the slit.

According to the seventh aspect of the invention, in the above-mentioned invention of the sixth aspect, the housing is provided with an engagement projection and a locking piece, the engagement projection being engageable with the locking piece when another housing identical to the housing is prepared and both of the housings are laid to overlap each other. In this case, owing to the provision of the engagement projection and the locking piece, it is possible to stack a plurality of housings while the engagement projection of one housing is engaged with the locking piece of the other housing.

According to the invention, there is also provided a method of manufacturing a metal fittings assembly for a joint connector, comprising:

preparing a pair of terminals each having a band-shaped carrier and a plurality of terminal units connected to the carrier at substantial right angles and arranged in parallel with each other in the longitudinal direction of the carrier;

overlapping the terminals each other;

bending respective joint portions between the carrier of one of the terminals and the terminal units of the one terminal by a plate thickness of the carrier of the other terminal, thereby positioning the adjoining terminal units of the terminals in an identical plane;

welding the band-shaped carriers of the terminals on each other; and cutting the carriers of the terminals for every predetermined number of terminal units required in accordance with the constitution of a connecting circuit as a product.

In this invention, by bending the joint portions of one terminal, it is possible to position the adjoining terminal units of the pair of terminals in the identical plane. Additionally, under condition that a plurality of housings are stacked vertically, it is possible to electrically connect the upper and lower terminal units with each other.

These and other objects and features of the present invention will become more fully apparent from the following description and appended claims taken in conjunction with the accompany drawings.

BRIEF DESCRIPTION OF THE DRAWINGS

FIG. 4A is a perspective view of the metal fittings and FIG. 4B is an enlarged sectional view of a part of the metal fittings;

DESCRIPTION OF THE PREFERRED EMBODIMENT

Embodiments of the present invention will be described with reference to the drawings showing the details of a joint connector of the invention.

FIGS. 3 to 16 show the embodiments of the present joint connector.

Figure 1:
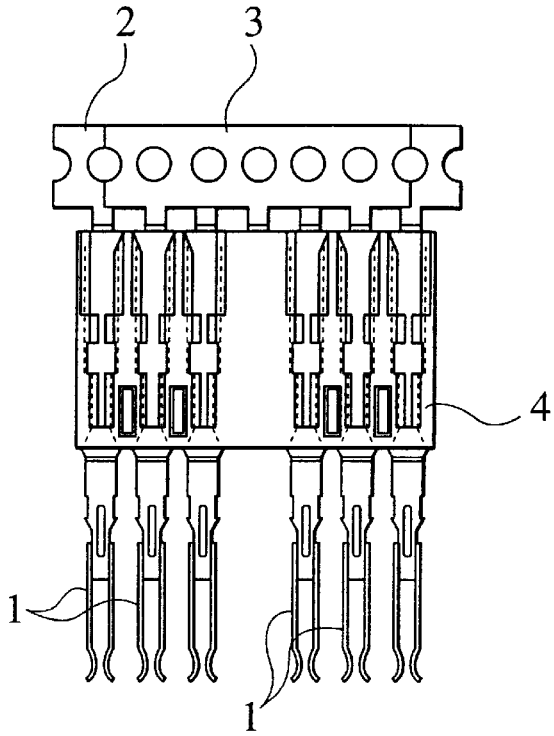
FIG.1 PRIOR ART
FIG. 1 is a plan view of the conventional connector element.
Figure 2:
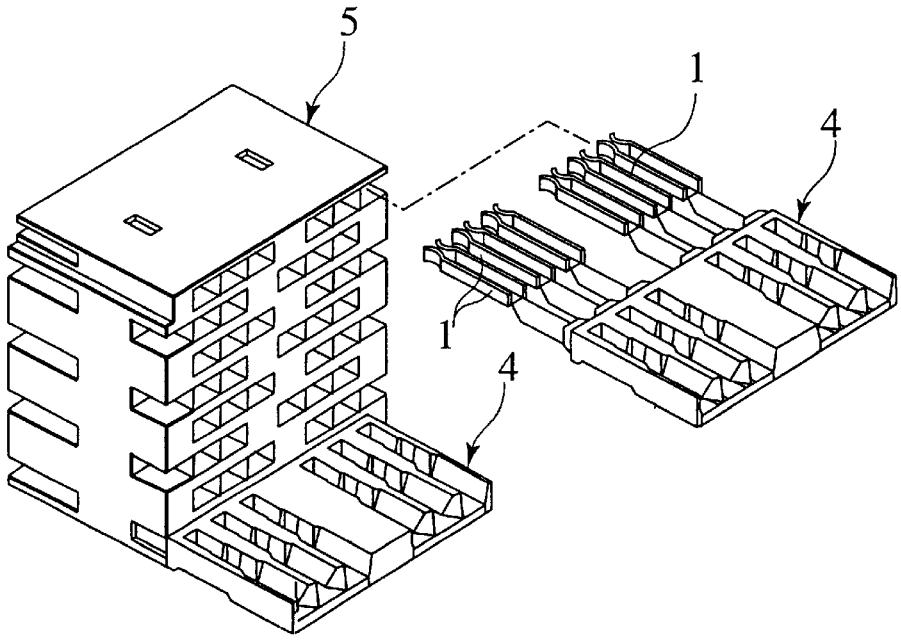
FIG.2 PRIOR ART
FIG. 2 is a perspective view of the conventional connector assembly.
Figure 3:
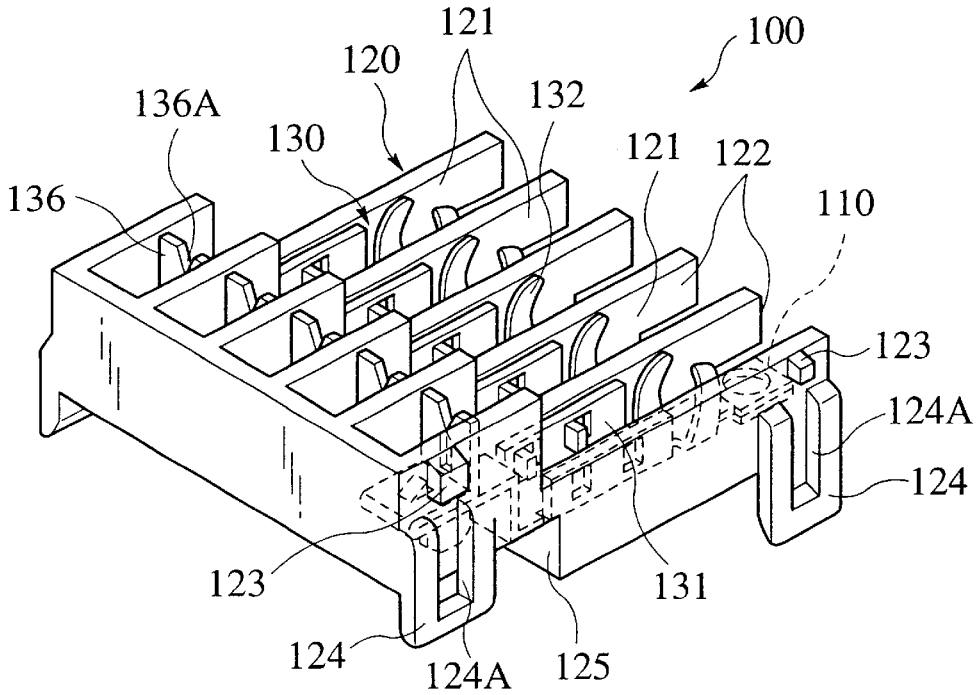
FIG. 3 is a perspective view showing a connector module in accordance with an embodiment of the joint connector of the invention.

FIG. 1 shows a module 100 constituting the joint connector of the embodiments. The module 100 consists of a "metal fittings" assembly 110 and a housing 120 for accommodating the metal fittings assembly 110.

Figure 4A:
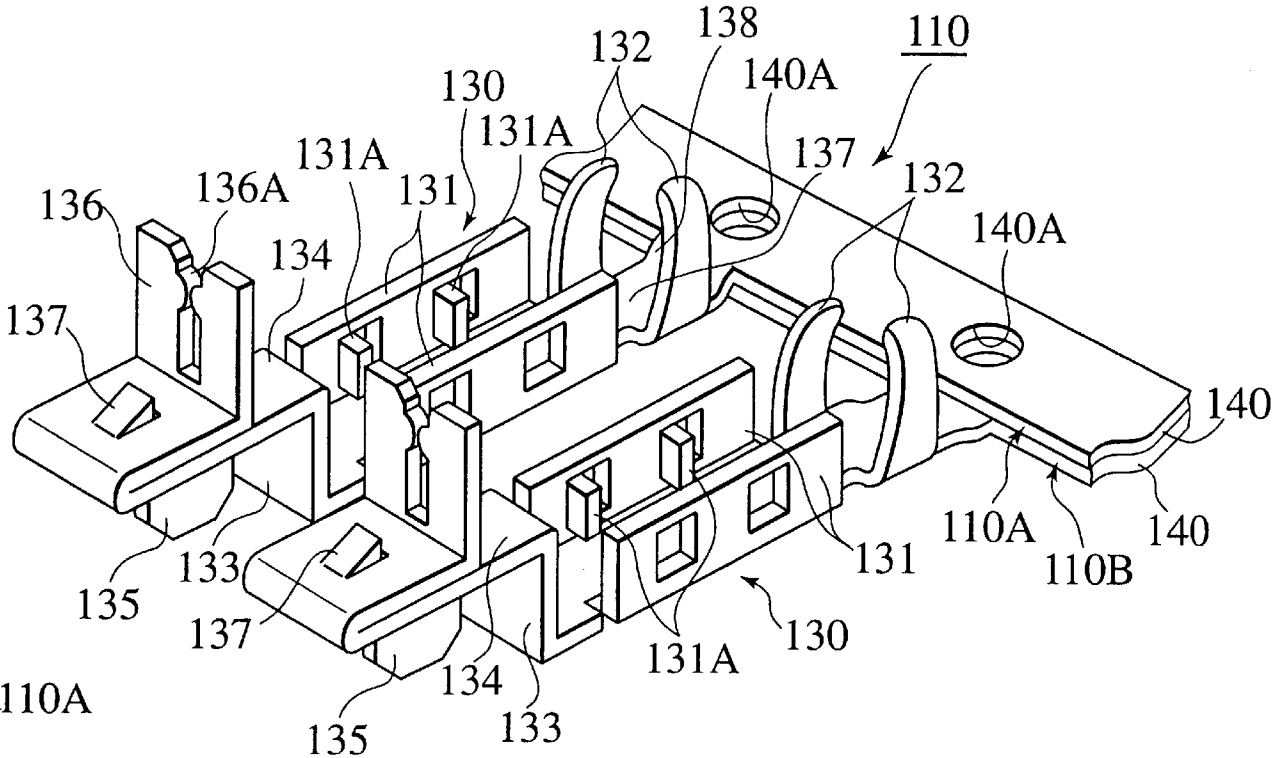
FIGS. 4A and 4B show metal fittings for terminal connection.

As shown in FIG. 4A, the metal fittings assembly 110 comprise a metallic terminal 110A and a terminal 110B which are laid to overlap each other. In each of the terminals 110A, 110B, a plurality of terminal units 130 each obtained by processing a metal plate are juxtaposed in multiple parallel rows and connected to each other through a carrier 140.

Figure 4B:
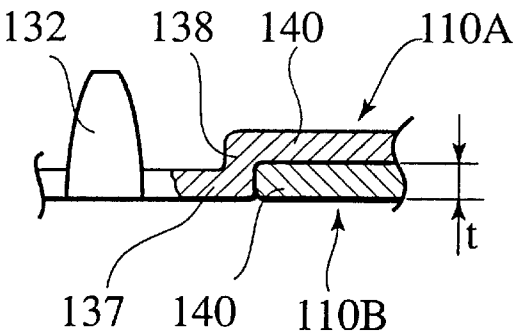

In the metal fittings assembly 110, the terminals 110A, 110B are shifted from each other in the longitudinal direction of the carriers 140,140 at predetermined intervals and the stacked carriers 140, 140 are welded to each other. In the upper terminal 110A, as shown in FIG. 4B, a joint part 137 is arranged between the carrier 140 and the terminal unit 130 and also provided with a bending part 138 which is obtained by partially bending the part 137 by a thickness (t) of the carrier 140 of the terminal 110B in order to position the adjoining terminal units 130, 130 in the identical horizontal plane. The manufacturing method of the metal fittings assembly 110 will be described later.

The housing 120 is made of insulation resin and comprises a plurality of unit-accommodating grooves 121 each defined by parallel partition walls 122 to accommodate each of the terminal units 130. Further, for engagement of the module 100, two projections 123 are formed on respective upper portions of a pair of parallel outside walls constituting the housing 120. Below the projections 123, engagement locking pieces 124, 124 are suspended from the outside walls of the housing 120, respectively. Each locking piece 124 is provided with an opening 124A into which the projection 123 of the other housing 120 is fitted for locking it.

Next, the terminal unit 120 as a constituent of the metal fittings assembly 110 will be described with reference to FIGS. 4A and 4B. As shown in FIG. 4A, each terminal unit 130 has a pair of wire pressing plates 131, 131 formed to stand on both sides at the intermediate part of the unit 130 in the longitudinal direction. Each pressing plate 131 is partially cut and bent inward to provide a pair of wire pressing pieces 131A, 131A. At the intermediate position between the wire pressing plates 131,131 and the carrier 140, a pair of bending pieces 132, 132 are formed to stand on both sides in the width direction of the terminal unit 130.

In front of the plates 131, 131 of the terminal unit 130, a rising piece 133 is formed so as to rise along a rising wall 125 of the housing 120. On the top of the rising piece 133, a horizontal plate 134 is formed so as to extend forward. On the back face of horizontal plate 134, an inserting piece 135 is bent so as to extend downward, constituting a connecting part of the terminal unit 130.

A leading portion of the horizontal plate 134 is folded back by a predetermined length and further raised to form a connecting piece 136. The connecting piece 136 is provided with a slit 136A into which the inserting piece 135 of the other terminal unit 130 is to be inserted.

Figure 16:
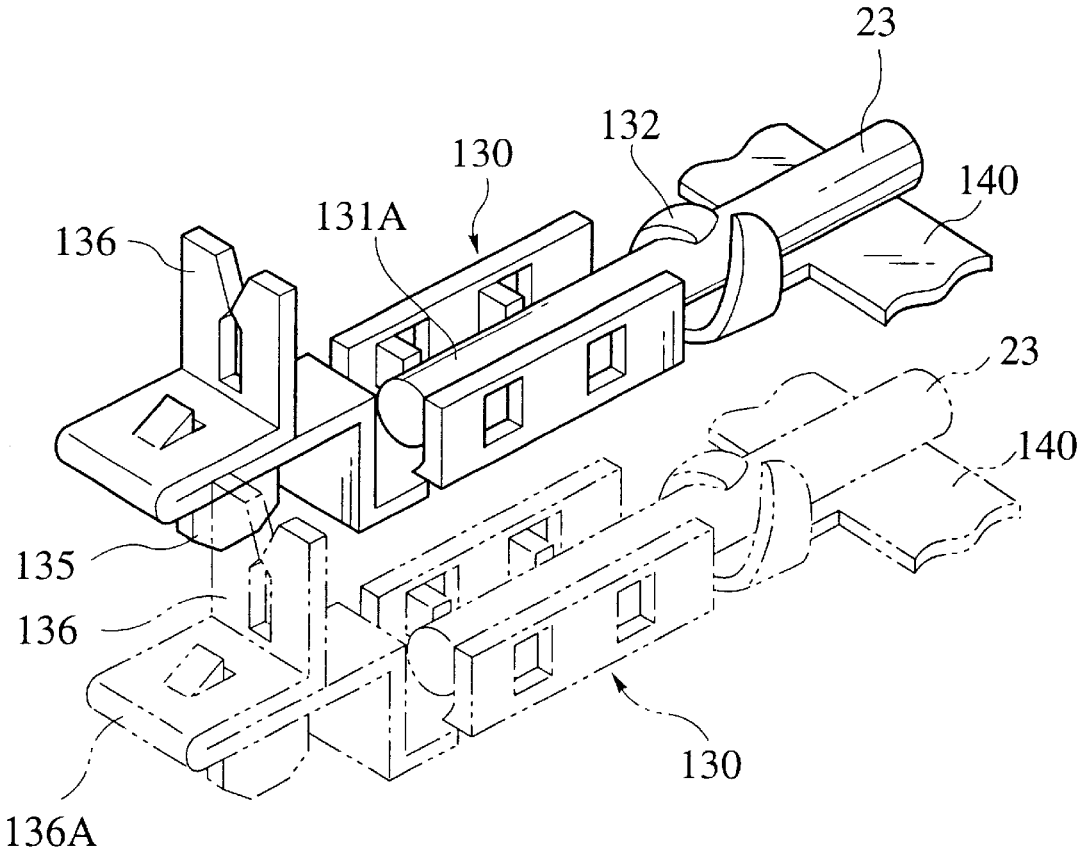
FIG. 16 is a perspective view showing a condition where terminal units are connected.

In order to connect a wire with the so-constructed terminal unit 130, as shown in FIG. 16, a wire 23 is inserted between the wire pressing plates 131, 131 under pressure to contact a not-shown conductor of the wire 23 with the wire pressing pieces 131A, 131A. Simultaneously, an insulating cover of the wire 23 is disposed between the opposing bending pieces 132, 132 and thereafter, the pieces 132, 132 are bent inward to hold the wire 23 therein.

In the housing 120 for accommodating the metal fittings assembly 110 having the juxtaposed terminal units 130, not-shown slits are formed to accept the inserting pieces 135 of the units 130 therein. The inserting pieces 135 inserted into the slits project from the under face of the housing 120 downwardly.

Figure 14:
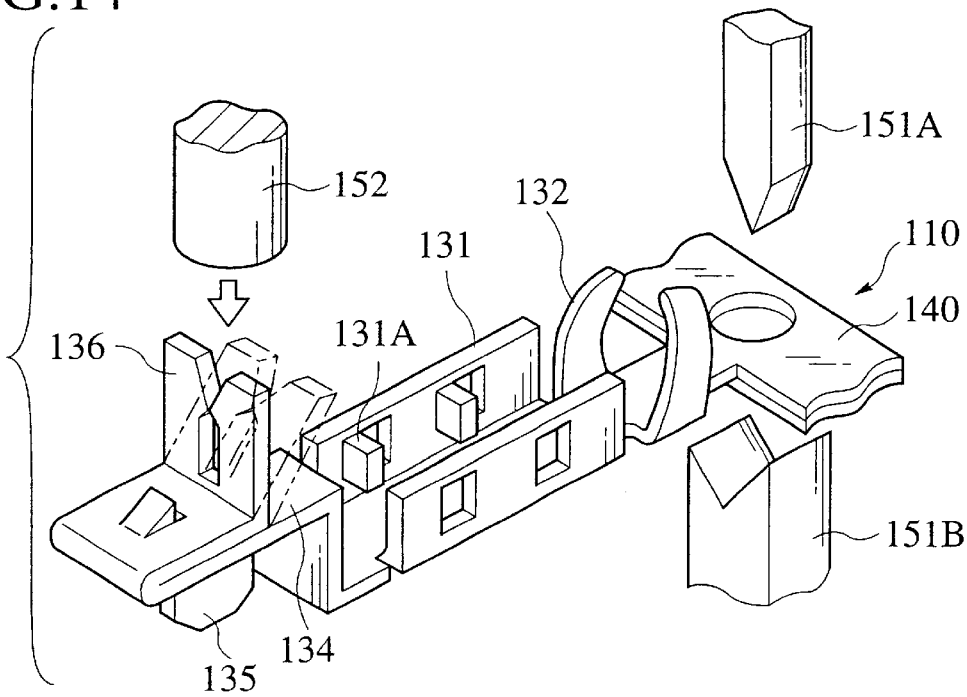
FIG. 14 is a perspective view showing a condition where the metal fittings of the embodiment is processed by a jig.

In order to separate the metal fittings assembly 110 into the terminal units 130 corresponding to the required connection circuit, it may be carried out to cut off the carrier 140 by using carrier cutting tools 151A, 151B after the metal fittings assembly 110 has been accommodated in the housing 120. In case of placing the modules 100 one upon another for effecting the connection between the upper module 110 and the lower module 110 and also case that it is not required to complete the connection between the upper terminal unit 130 and the corresponding lower terminal unit 130 at the specified position in the upper and lower modules 100, 100, the connecting piece 136 of the lower terminal unit 130 has only to be bent by means of a holding tool 152, as shown in FIG. 14.

Figure 15:
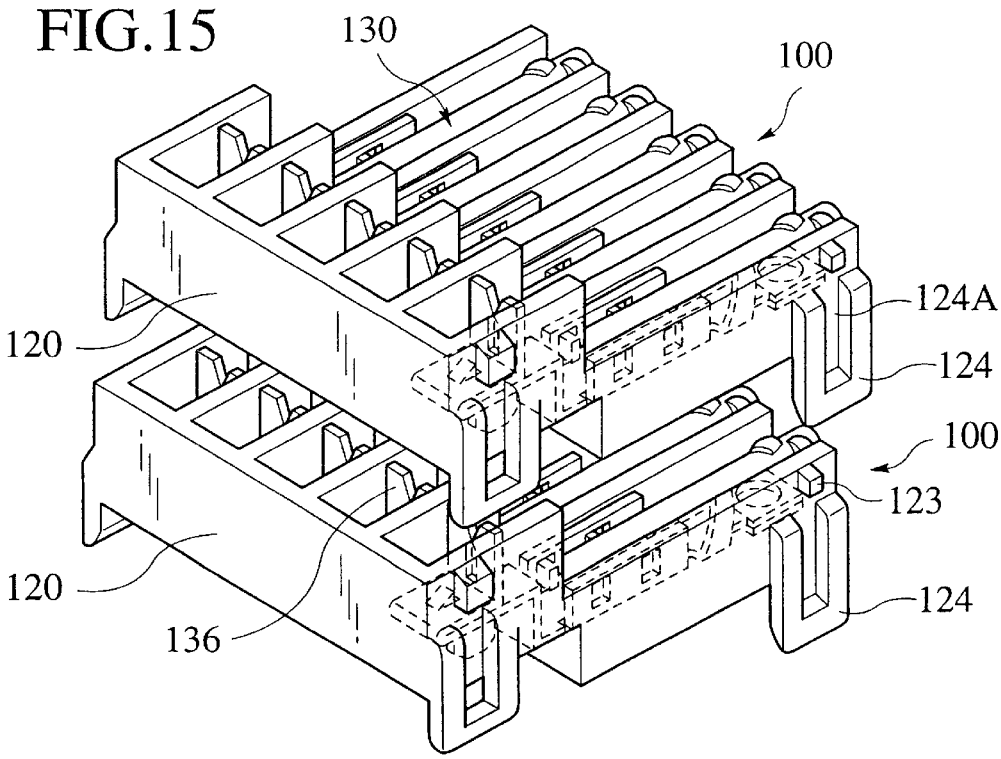
FIG. 15 is a perspective view showing a method of assembling the modules of the embodiment.

We now describe the method of overlaying the modules 100 each having the plural terminal units 130 fitted in the housing 120, on each other. At first, it is executed to stack the modules 100 up and down while the wires are being connected with the respective terminal units 130, as shown in FIG. 15. Next, by fitting the engagement projections 123 of the lower housing 120 in the openings 124A of the upper housing 120, the upper and lower modules 100, 100 can be integrated into one body in the locked condition.

At this time, in an area requiring the electrical connection against the terminal units 130 in the lower housing 120, the inserting pieces 135 of the upper terminal units 130 are inserted into the slits 136A in the connecting pieces 136 of the lower terminal units 130 for electrical connection.

Figure 5:
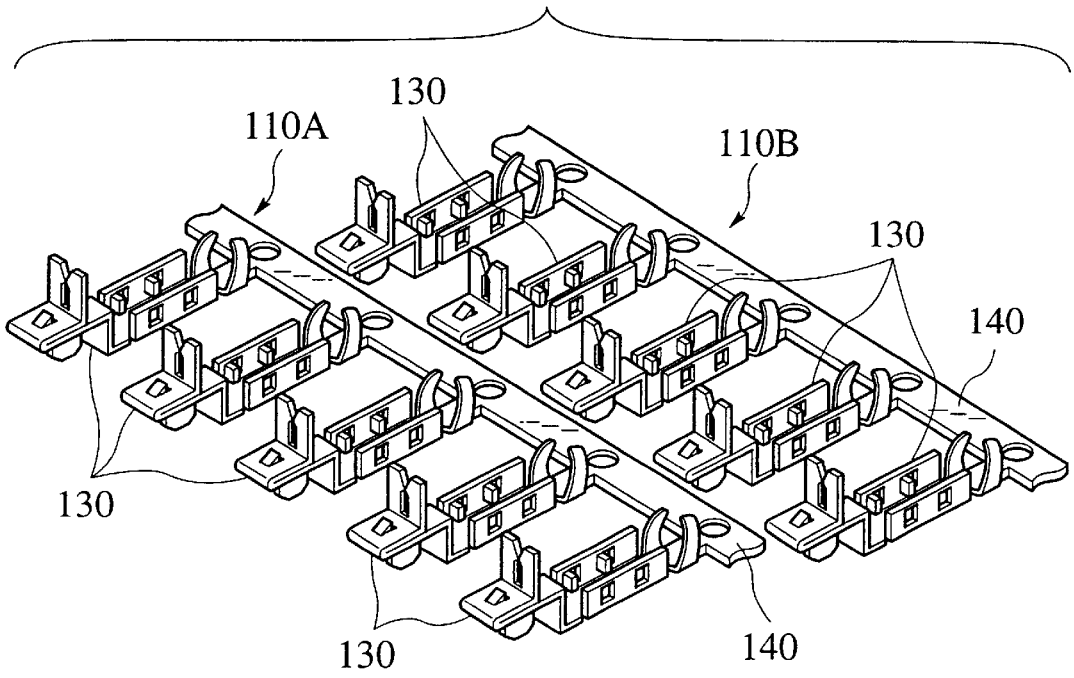
FIG. 5 is a perspective view showing the metal fittings of the embodiment of the present invention.

The manufacturing method of the metal fittings assembly 110 will be described with reference to FIGS. 5 to 9. As shown in FIG. 5, the completed metal fittings assembly 110 of the embodiment is constituted by two terminals 110A, 110B of which carriers 140,140 are welded on each other while they are shifted so that the terminal units 130 of one terminal 110A alternate with those of the other terminal 110B, by half of interval (i.e., half pitch) separating each terminal unit 130 in one terminal.

Figure 7:
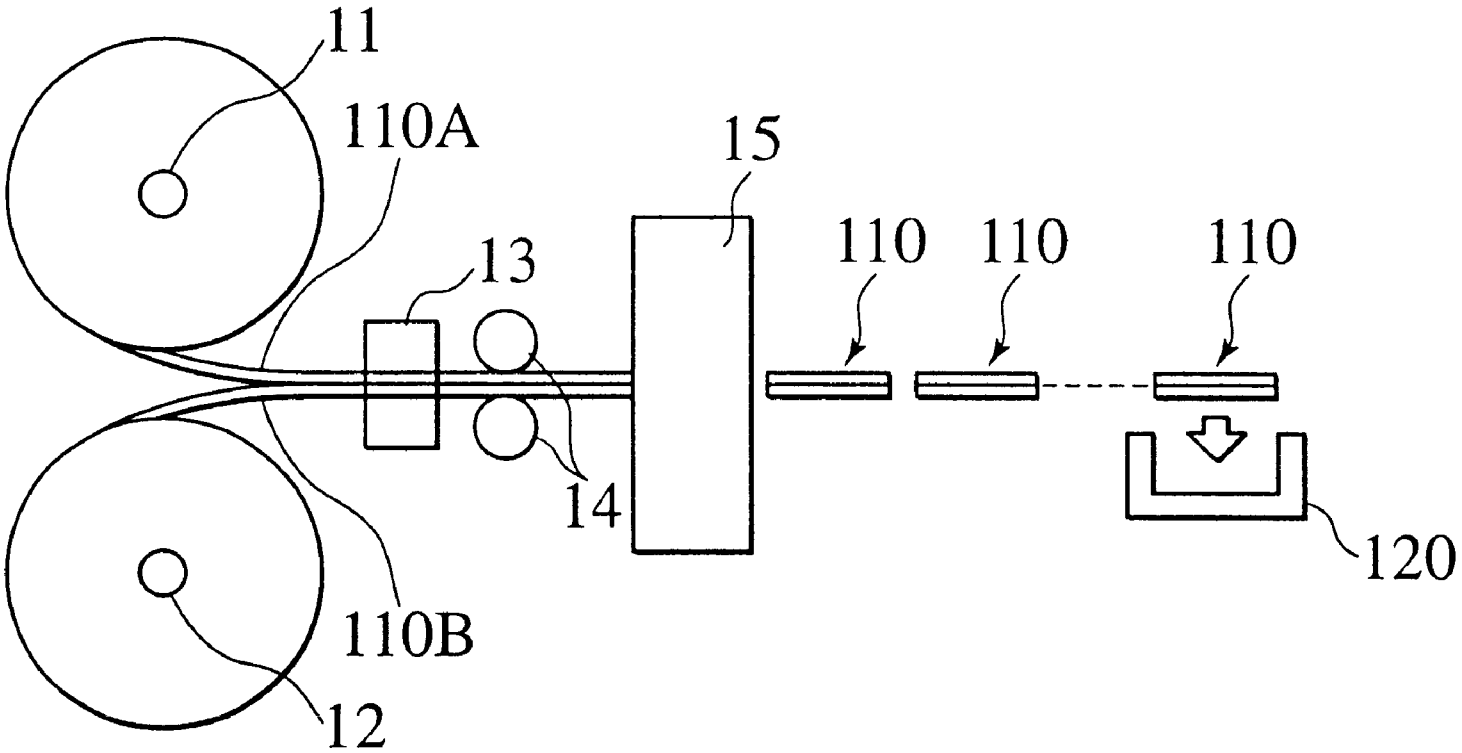
FIG. 7 is an explanatory diagram showing a manufacturing method of the metal fittings of the embodiment.
Figure 8:
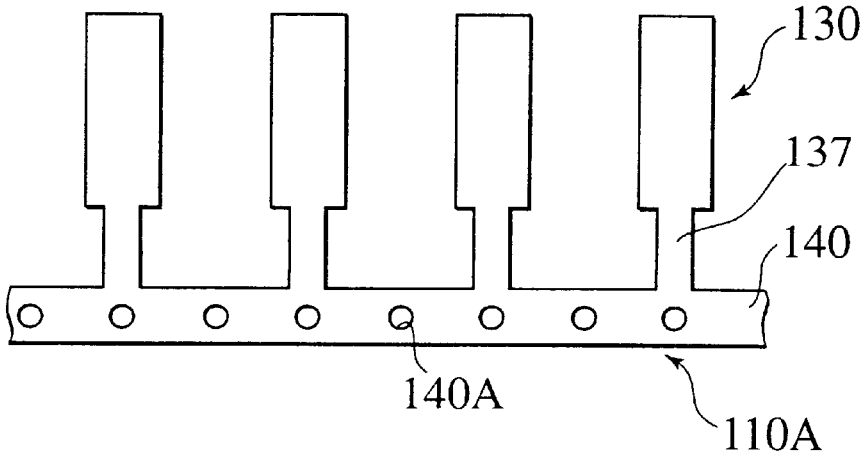
FIG. 8 is a plan view showing the metal fittings of the embodiment of the present invention.
Figure 9:
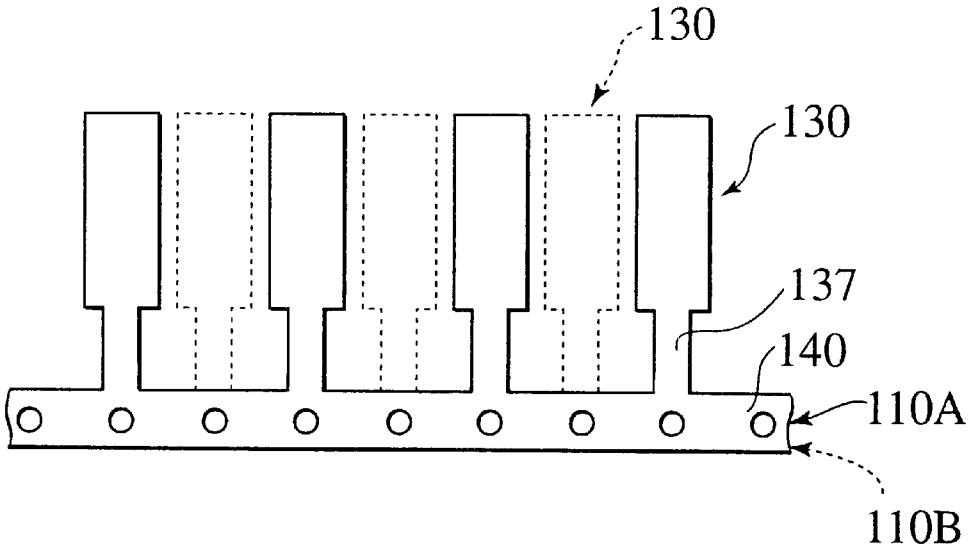
FIG. 9 is a plan view showing the metal fittings of the embodiment of the present invention.

In order to produce the metal fittings assembly 110, as shown in FIG. 7, two reels 11,12 respectively reeling the continuous terminals 110A, 110B are arranged to oppose each other, first of all. Next, being shifted from each other by the half pitch, the terminals 110A, 110B are drawn out of the reels 11,12 respectively and overlapped with each other. FIG. 8 is a plan view illustrating the terminal 110A and FIG. 7 is a plan view showing a condition that the terminals 110A, 110B are shifted by the half pitch to overlap with each other.

Note, since the terminals 110A, 110B are respectively provided with positioning holes 140A in alignment with the terminal unit 130 as well as at an equally spaced distance between adjacent terminal units 130, these positioning holes 140A can be easily adjusted between the upper terminal 110A and the lower terminal 110B to align the terminals 110A. 110B. During manufacture of the terminals, the terminals 110A, 110B are bent to form the terminal units 130 by a bending machine 13. In addition, each joint part 137 between the carrier 140 and the terminal unit 130 of the terminal 110A is bent to form the bending part 138 so that the terminal units 130 of the terminals 110A, 110B are on the identical horizontal plane.

Figure 6:
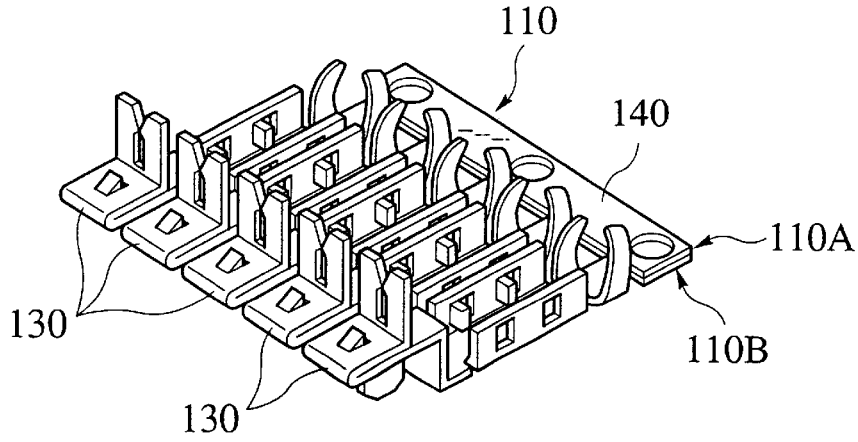
FIG. 6 is a perspective view showing the metal fittings of the embodiment of the present invention.

Owing to the above bending process, there can be completed the metal fittings assembly 110 as shown in FIG. 4A. Further, the carriers 140, 140 of the metal fittings assembly 110 are welded to each other by a welding machine 14 and thereafter, by a cutting machine 15, the integrated carriers 140, 140 of the metal fittings assembly 110 are cut corresponding to the housing 120, as shown in FIG. 6. Subsequently, the so-cut metal fittings assembly 110 are inserted and fitted into the housing 120.

Figure 10:
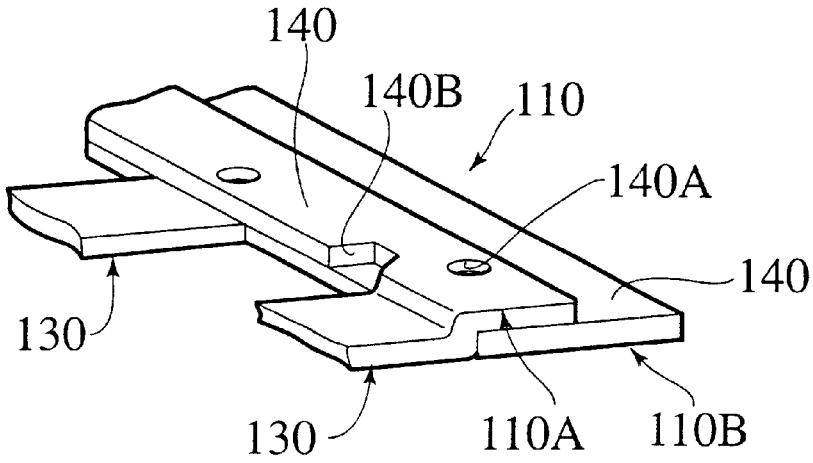
FIG. 10 is a perspective view showing the metal fittings in the modification of the embodiment.
Figure 11:
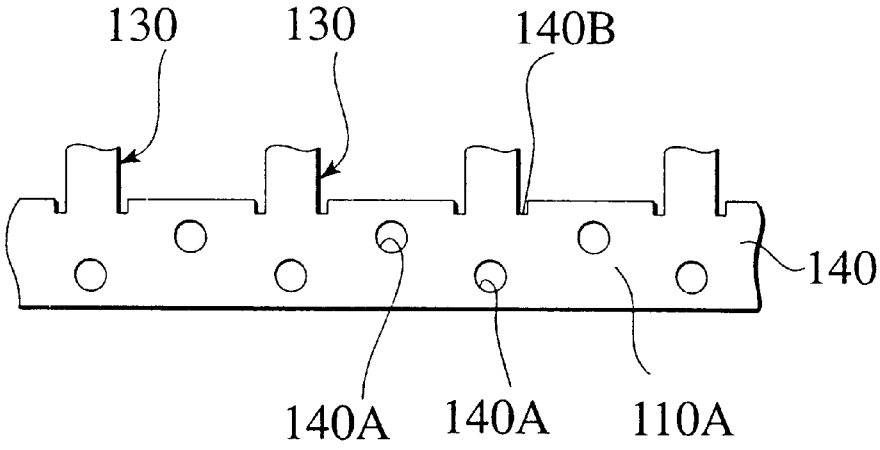
FIG. 11 is a plan view showing the metal fittings in the modification of the embodiment.

FIGS. 10 to 13 illustrate the modifications of the metal fittings assembly 110 of the embodiment. FIGS. 10 and 11 show the arrangement where the upper metal terminal 110A is shifted forward with respect to the lower metal terminal 110B and the front part of the carrier 140 of the terminal 110A is bent downwardly so that the terminal units 130 of both of the terminals 110A, 110B are all on the indention plane. Note, the metal terminal 110A is provided, on respective carrier portions interposing each terminal unit 130, with notches 140B for facilitating the bending.

Further, the metal terminal 110A has the positioning holes 140A formed on the carrier 140 in zigzags.

Figure 12:
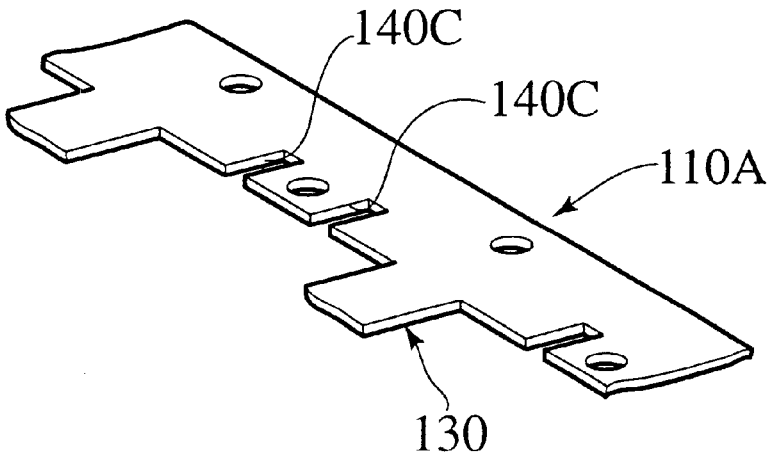
FIG. 12 is a perspective view showing the metal fittings in the modification of the embodiment.
Figure 13:
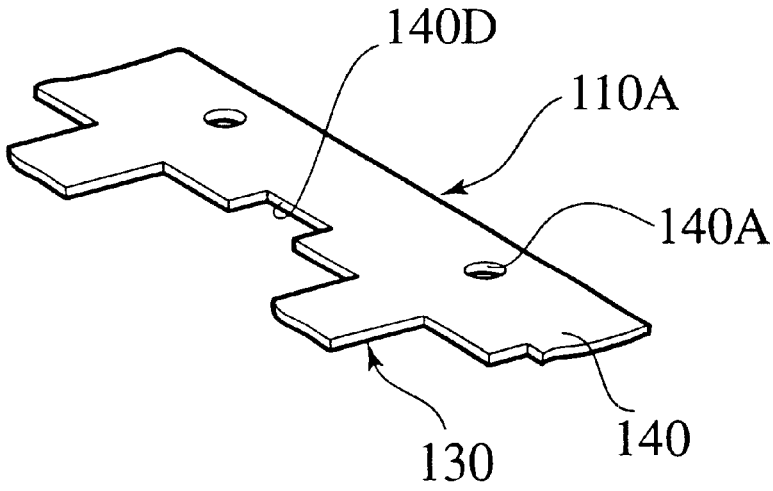
FIG. 13 is a perspective view showing the metal fittings in the modification of the embodiment.

FIG. 12 shows another modification of the metal terminal 110A. In this modification, the metal terminal 110A is provided with notches 140C, 140C corresponding to both sides of each terminal unit 130 of the lower metal terminal 110B. Similarly, FIG. 13 shows the other modification where the metal terminal 110A are provided with notches 140D corresponding to the positions of the terminal units 130 of the lower metal terminal 110B and each having a width equal to that of the terminal unit 130.

In common with the embodiments employing the above-mentioned metal terminal 110A, since the required modules 100 are stacked up by cutting of the carriers 130 and/or bending the connecting pieces 136 corresponding to the required circuit arrangement, it is possible to establish the connecting and branching in wiring at will.

Again, since the metal fittings assembly 110 may be constructed by the terminals 110A, 110B of identical configuration, the sorts of components are not increased thereby to facilitate both production and management of components. Additionally, since the carriers 140 are together welded to each other, it is possible to ensure the electrical conduction between the terminals 110A, 110B. Moreover, if only coinciding the positioning holes 140A with each other, the positioning of the terminals 110A, 110B can be performed with ease.

Here, the present invention is not limited to the shown embodiments and various changes and modifications may be made to the present invention, accompanying with the gist of invention. For example, although the metal fittings assembly 110 are composed of two terminals 110A, 110B stacked and welded to each other in the above-mentioned embodiments, the present invention is not limited to those, of course.

Furthermore, the lower terminal 110B may be provided with bending parts instead of the bending parts 138 on the upper terminal 110A.

Finally, it will be understood by those skilled in the art that the foregoing description is related to preferred embodiments of the disclosed joint connector and that various changes and modifications may be made to the present invention without departing from the spirit and scope thereof.

What is claimed is:

1. A method of manufacturing a metal fittings assembly for a joint connector, comprising:

providing a pair of terminals each having a band-shaped carrier and a plurality of terminal units connected to the carrier at substantial right angles and arranged in parallel with each other in a longitudinal direction of the carrier;

wherein each of the terminal units has a connecting piece formed on a leading end portion of the terminal unit so as to project upward and an inserting piece formed on the leading end portion so as to extend downward;

aligning the pair of terminals in an overlapping relationship;

bending respective joint portions between the carrier of one of the terminals and the terminal units of that terminal by a thickness of the carrier of the other terminal, thereby positioning the terminal units of the overlapped terminals in an identical plane;

welding the band-shaped carriers of the terminals together;

cutting the carriers of the terminals for every predetermined number of terminal units required in accordance with a constitution of a connecting circuit as a product; and engaging a connecting piece of a first terminal unit with an inserting piece of a second terminal unit.

* * * * *